US011596254B2

(12) United States Patent
Jennings

(10) Patent No.: US 11,596,254 B2
(45) Date of Patent: Mar. 7, 2023

(54) MAILBOX NOTIFICATION APPARATUS

(71) Applicant: Gregory A. Jennings, Broomall, PA (US)

(72) Inventor: Gregory A. Jennings, Broomall, PA (US)

( * ) Notice: Subject to any disclaimer, the term of this patent is extended or adjusted under 35 U.S.C. 154(b) by 0 days.

(21) Appl. No.: 17/653,337

(22) Filed: Mar. 3, 2022

(65) Prior Publication Data

US 2022/0378236 A1 Dec. 1, 2022

Related U.S. Application Data

(60) Provisional application No. 63/200,706, filed on Mar. 23, 2021.

(51) Int. Cl.
*A47G 29/122* (2006.01)
*A47G 29/12* (2006.01)

(52) U.S. Cl.
CPC ..... *A47G 29/1225* (2013.01); *A47G 29/121* (2013.01); *A47G 2029/1229* (2017.08); *A47G 2029/12105* (2017.08)

(58) Field of Classification Search
CPC ..... A47G 29/1225; A47G 29/121; A47G 2029/1229; A47G 2029/12105
USPC ..... 232/35
See application file for complete search history.

(56) References Cited

U.S. PATENT DOCUMENTS 2,483,992 A * 10/1949 Young ..... A47G 29/121 232/35
2,730,298 A * 1/1956 Haserodt ..... G11B 7/08529 232/35
2,874,895 A * 2/1959 Opp ..... A47G 29/121 232/35
3,102,684 A * 9/1963 Eging ..... A47G 29/121 232/35
3,338,511 A * 8/1967 Cvar ..... A47G 29/121 232/35
3,343,784 A * 9/1967 Waldhaus ..... A47G 29/121 232/35
3,523,639 A * 8/1970 Wiebe ..... A47G 29/121 232/35
4,491,268 A * 1/1985 Faulkingham ..... A47G 29/121 232/35
4,702,411 A * 10/1987 Yager ..... A47G 29/121 232/35
4,793,552 A * 12/1988 Revels ..... A47G 29/121 232/35
4,840,307 A * 6/1989 Hartman ..... A47G 29/121 232/35
5,489,064 A * 2/1996 Shively ..... A47G 29/121 232/34
5,865,368 A * 2/1999 Taylor ..... A47G 29/121 232/35

(Continued)

*Primary Examiner* — William L Miller
(74) *Attorney, Agent, or Firm* — FisherBroyles, LLP; Keats Quinalty

(57) ABSTRACT

A notification apparatus and method for a package receptacle, such as a mailbox, including a receiving door with a closure lip, a mounting plate, a notification flap, and a self-contained spring loaded hinge between the mounting plate and the notification flap. The mounting plate is securable to a mailbox with at least a portion of the notification flap securable under a door of the mailbox, and, when the door is opened, the flap rotates approximately 90-degrees about the hinge toward the mounting plate.

16 Claims, 9 Drawing Sheets

(56) References Cited

U.S. PATENT DOCUMENTS

| | | | | |
|---|---|---|---|---|
| 6,065,671 | A * | 5/2000 | Stepleton | A47G 29/121 232/35 |
| 7,270,260 | B1 * | 9/2007 | Powers | A47G 29/121 232/35 |
| 2006/0102710 | A1 * | 5/2006 | Griffeth | A47G 29/121 232/34 |
| 2007/0210146 | A1 * | 9/2007 | Crowson | A47G 29/121 232/34 |
| 2015/0021384 | A1 * | 1/2015 | Beachy | A47G 29/121 232/35 |

* cited by examiner

MAILBOX NOTIFICATION APPARATUS

Receptacles to receive packages, such as mailboxes, provide easy access for postal delivery to accelerate mail delivery by postal delivery workers. However, property owners are unable to know when mail has been delivered without traveling to open the mailbox.

BRIEF DESCRIPTION OF THE DRAWINGS

The accompanying drawings, which are incorporated herein and constitute part of this specification, illustrate the presently preferred embodiments, and, together with the general description given above and the detailed description given below, serve to explain features.

DETAILED DESCRIPTION

Figure 1A:
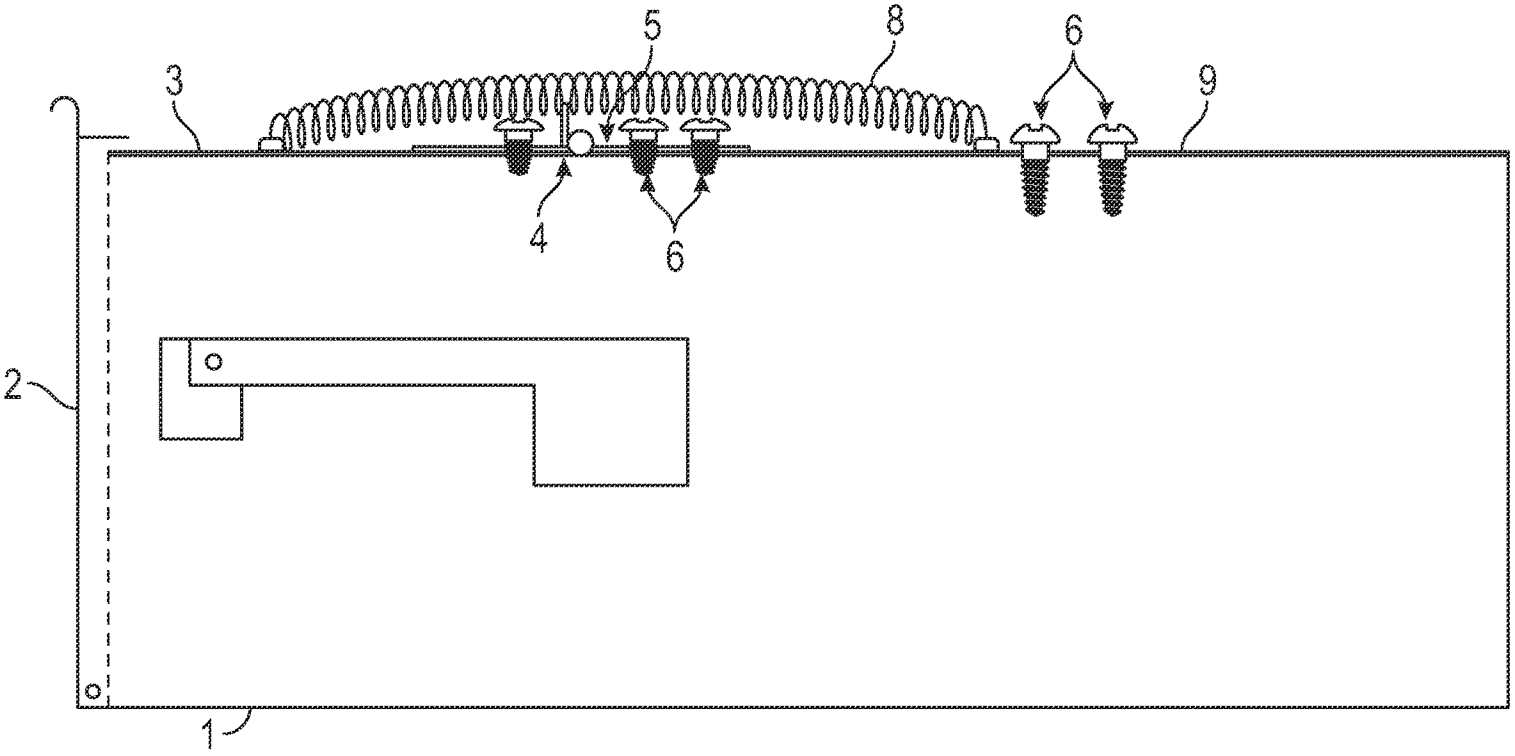
FIGS. 1A and 1B depict a prior art mailbox notification flag apparatus.

In the drawings, like numerals indicate like elements throughout. Certain terminology is used herein for convenience only and is not to be taken as limiting. The terms "distal" and "proximal" where used refer, respectively, to directions closer to and away from a front portion of a mailbox for example. The terminology includes the words specifically mentioned, derivatives thereof and words of similar import. The embodiments illustrated below are not intended to be exhaustive or to limit the disclosure to the precise form disclosed. These embodiments are chosen and described to best explain the principle of the disclosure and its application and practical use and to enable others skilled in the art to best utilize the disclosure.

An exemplary system, method, and apparatus is described hereinbelow and shown in the appended figures. In at least one exemplary embodiment, a notification system, method, and apparatus is provided for a package receptacle, such as a mailbox, having a door or operable lid with an overlapping lip. While the present disclosure is applicable to any package receptacle, specifically for package receptacles having a door with an overhanging lip or extension that can receive a notification flag or flap, the term "mailbox" is used generally throughout this disclosure in a non-limiting manner and will be understood to encompass a broader class of receptacles than any specific restrictions from the term "mailbox" if such term is understood as limiting in any manner. Additionally, the exemplary embodiment shown in the figures and detailed in the disclosure can be scaled in size to be larger or smaller relative to the size of the package receptacle or mailbox. The notification system, method, and apparatus provides visual notification that mail and/or package has been added to a mailbox and/or package receptacle or that outgoing mail has been picked up from the mailbox. The notification flap or flag can be seen a distance from the mailbox, including, in one example, up to approximately 125 feet away. The present notification apparatus provides numerous benefits, including enabling a user to eliminate wasted visits to the mailbox to check whether mail has been added to the mailbox or whether outgoing mail has been picked up from the mailbox. In one exemplary method, a user can observe whether the notification apparatus has been activated, such as, during bad weather, to allow instant notification that mail has been delivered or that outgoing mail picked up without requiring that the user open the mailbox.

Figure 1B:
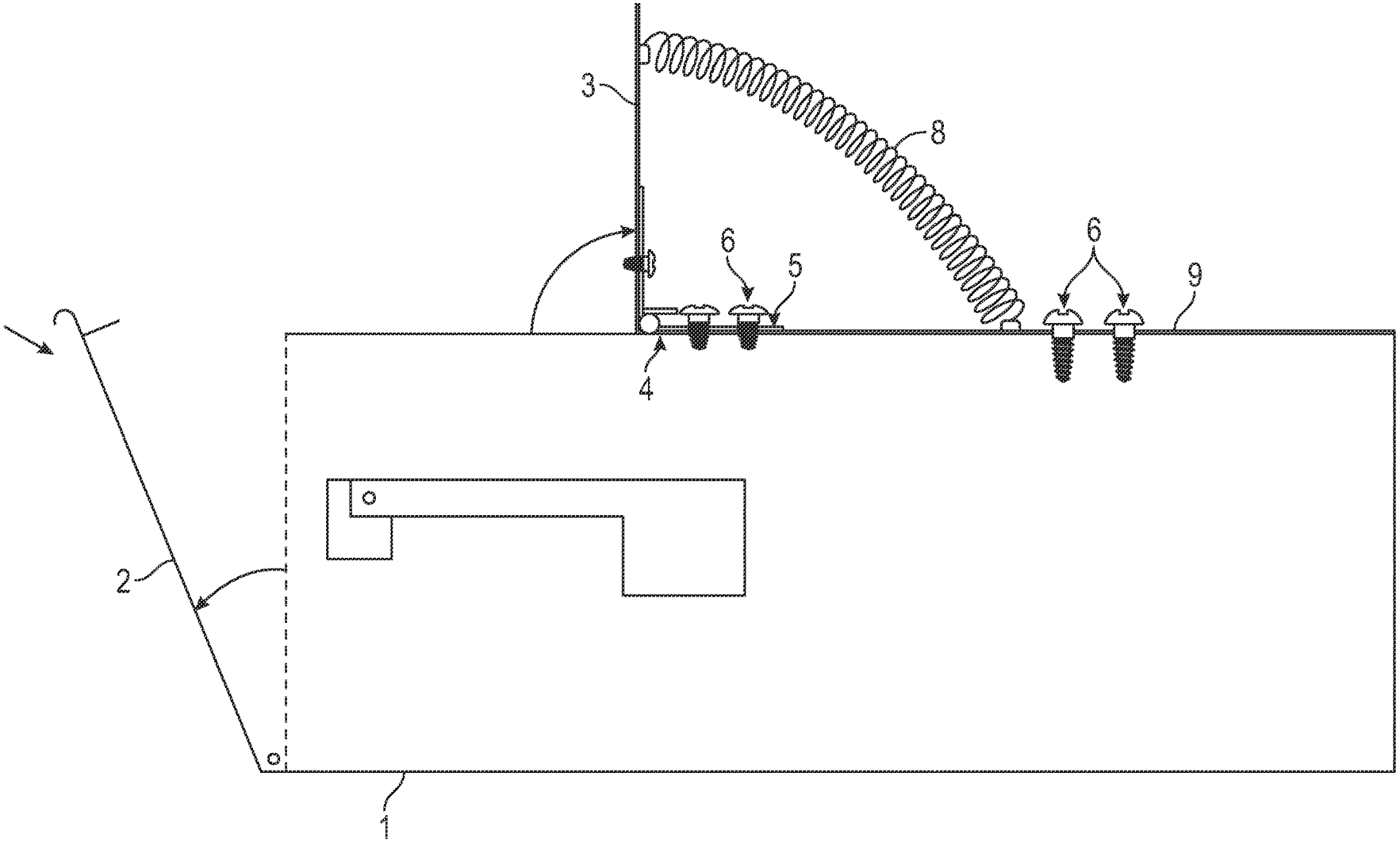

FIGS. 1A and 1B generally depict a prior art mailbox notification flag apparatus. As shown in FIGS. 1A and 1B, the mailbox notification flag apparatus included a steel hinge with a mounting plate 9 on one side and an operable aluminum flap or flag 3 on the other side. The mounting plate 9 is mounted to the top of hinge 5 by screws 6 of a mailbox 1 with a steel elongated spring 8 attached to the operable notification flag 3 and mounting plate 9. When the mailbox door 2 was opened to put mail into the mailbox 1, the flag 3 would be released and be pulled up by the attached spring 8 until stop 4 engaged mounting plate 9.

Figure 2A:
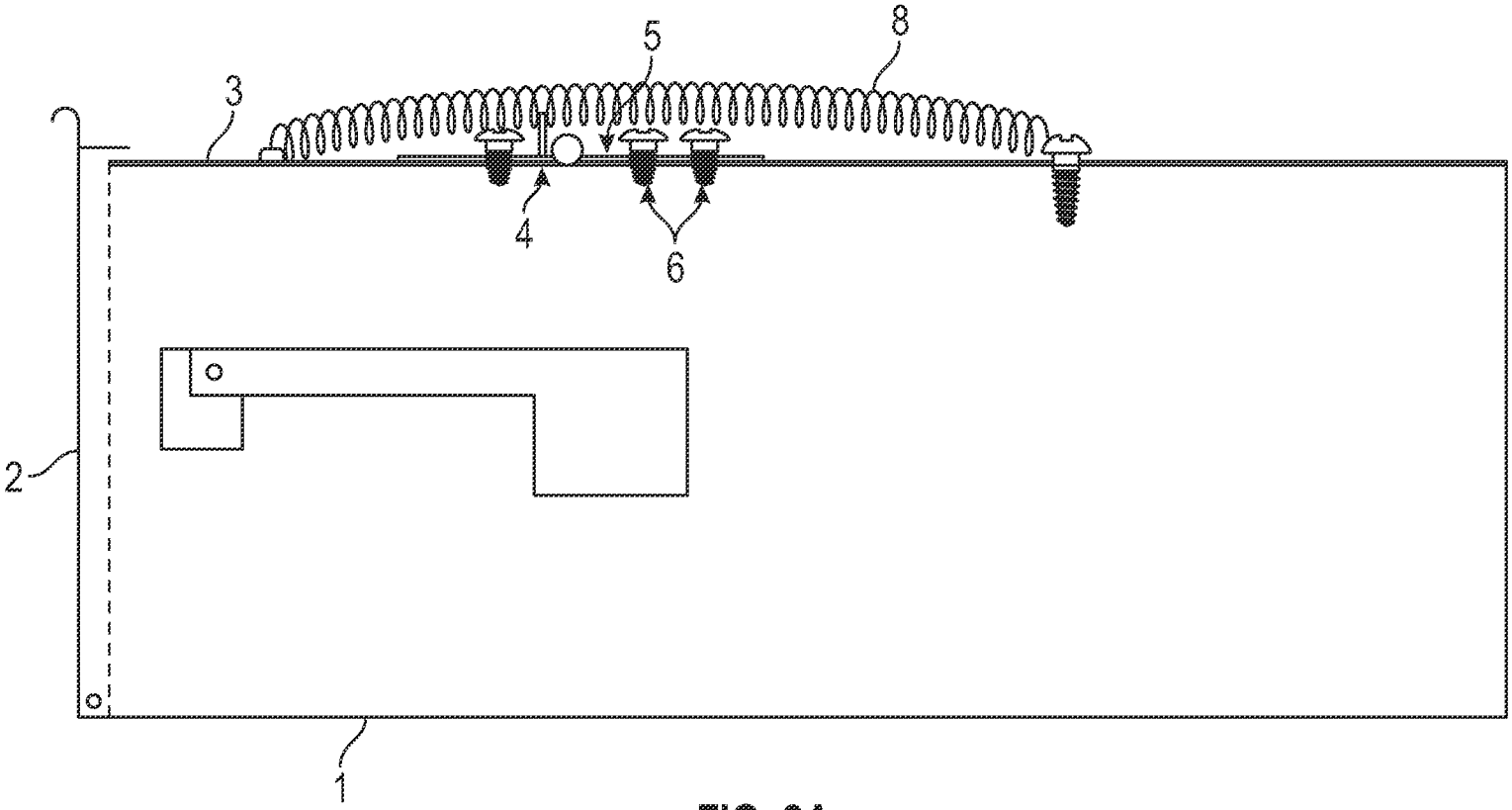
FIGS. 2A and 2B depict another prior art mailbox notification flag apparatus.
Figure 2B:
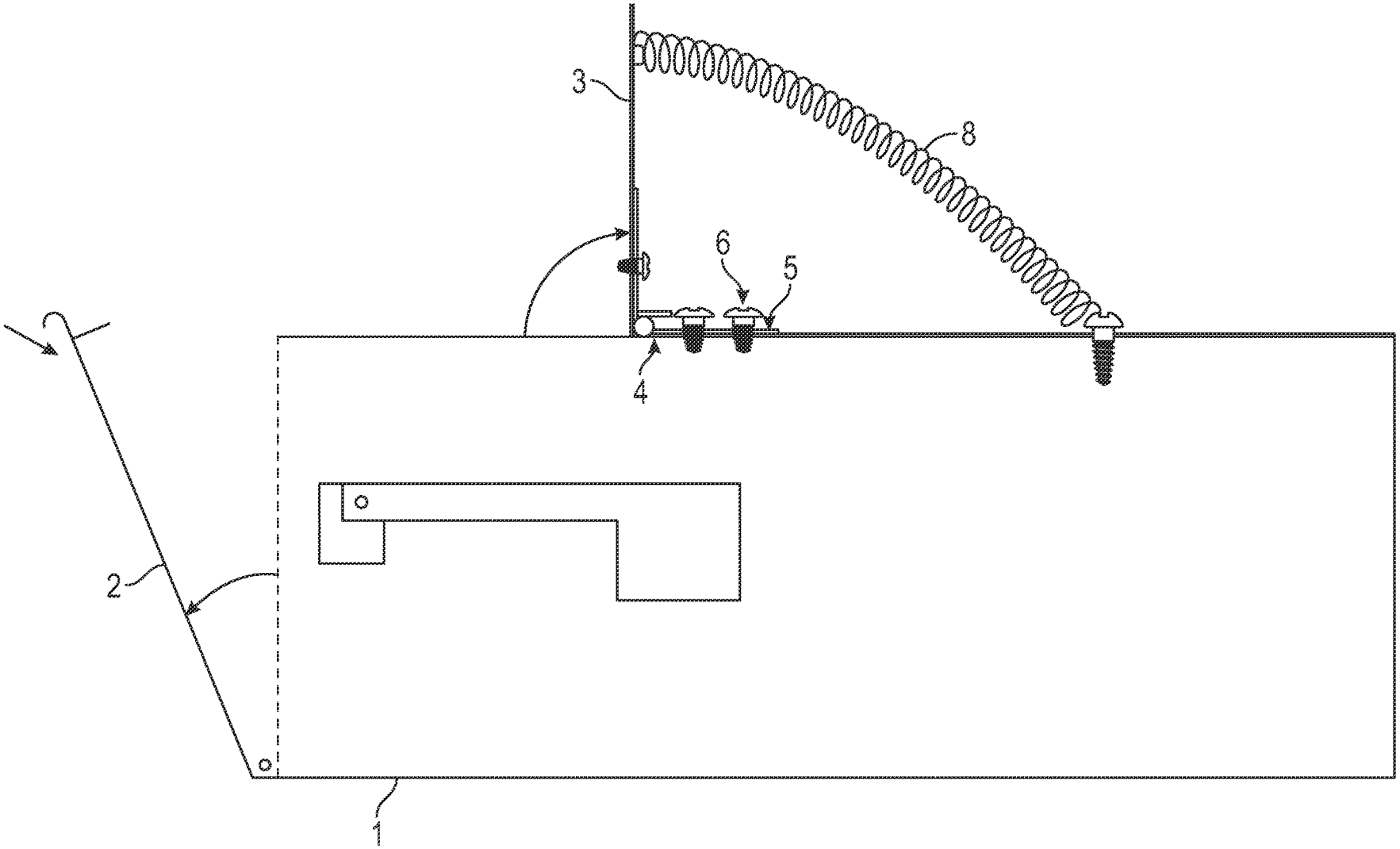

FIGS. 2A and 2B generally depict another prior art mailbox notification flag apparatus, which did not include an aluminum mounting plate. While the hinge was mounted directly to the mailbox 1, the spring 8 was instead attached to both to the operable flag 3 and directly to the top of mailbox 1. The spring 8 pulled the flag 3 up when the mailbox door 2 was opened from the top of the mailbox 1. However, the prior apparatus of FIGS. 1A, 1B, 2A, and 2B suffered from quality, performance, and longevity issues, especially due to exposure of the spring to weather.

Figure 3A:
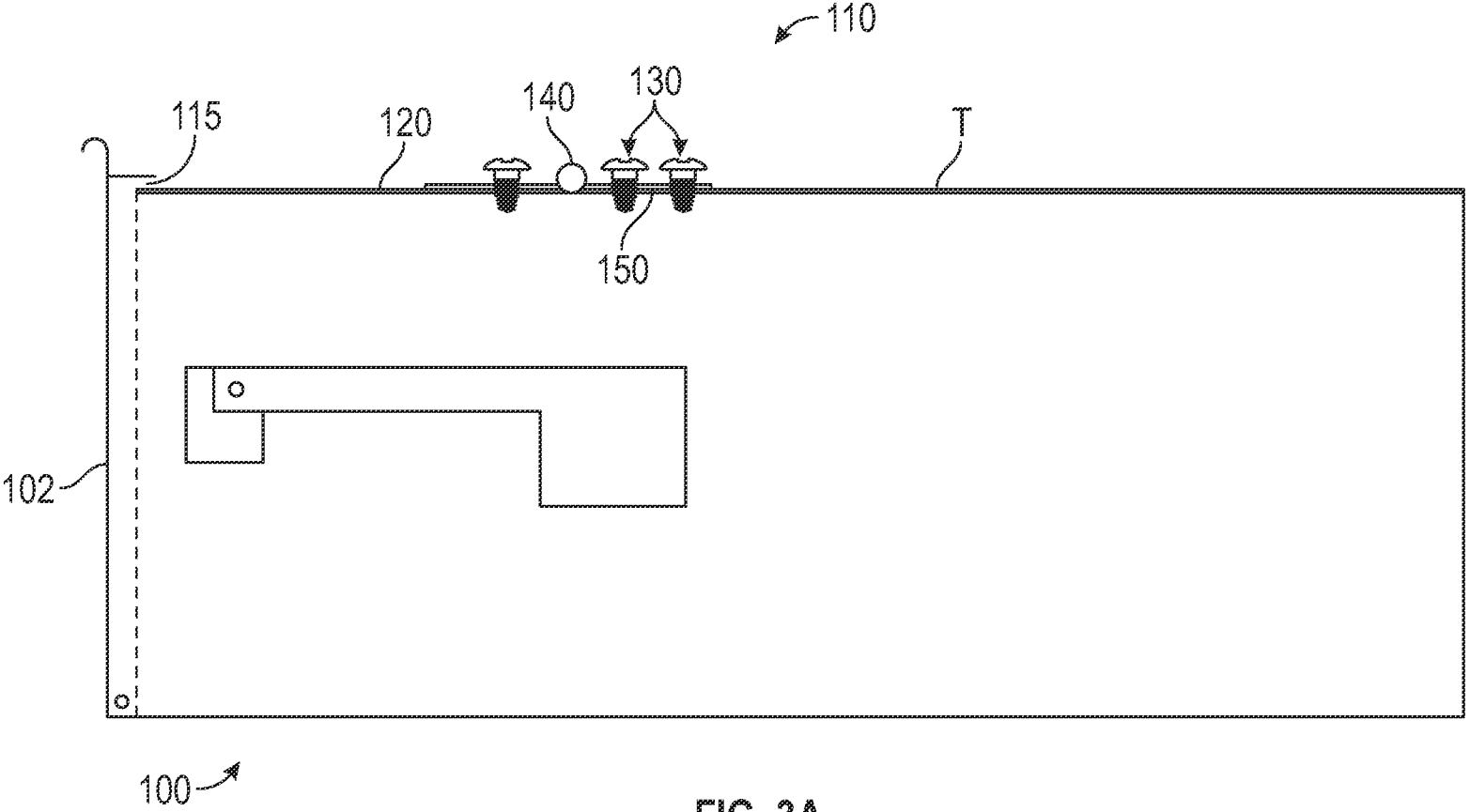
FIGS. 3A, 3B, and 3C show elements of a first embodiment of a mailbox notification apparatus.
Figure 3B:
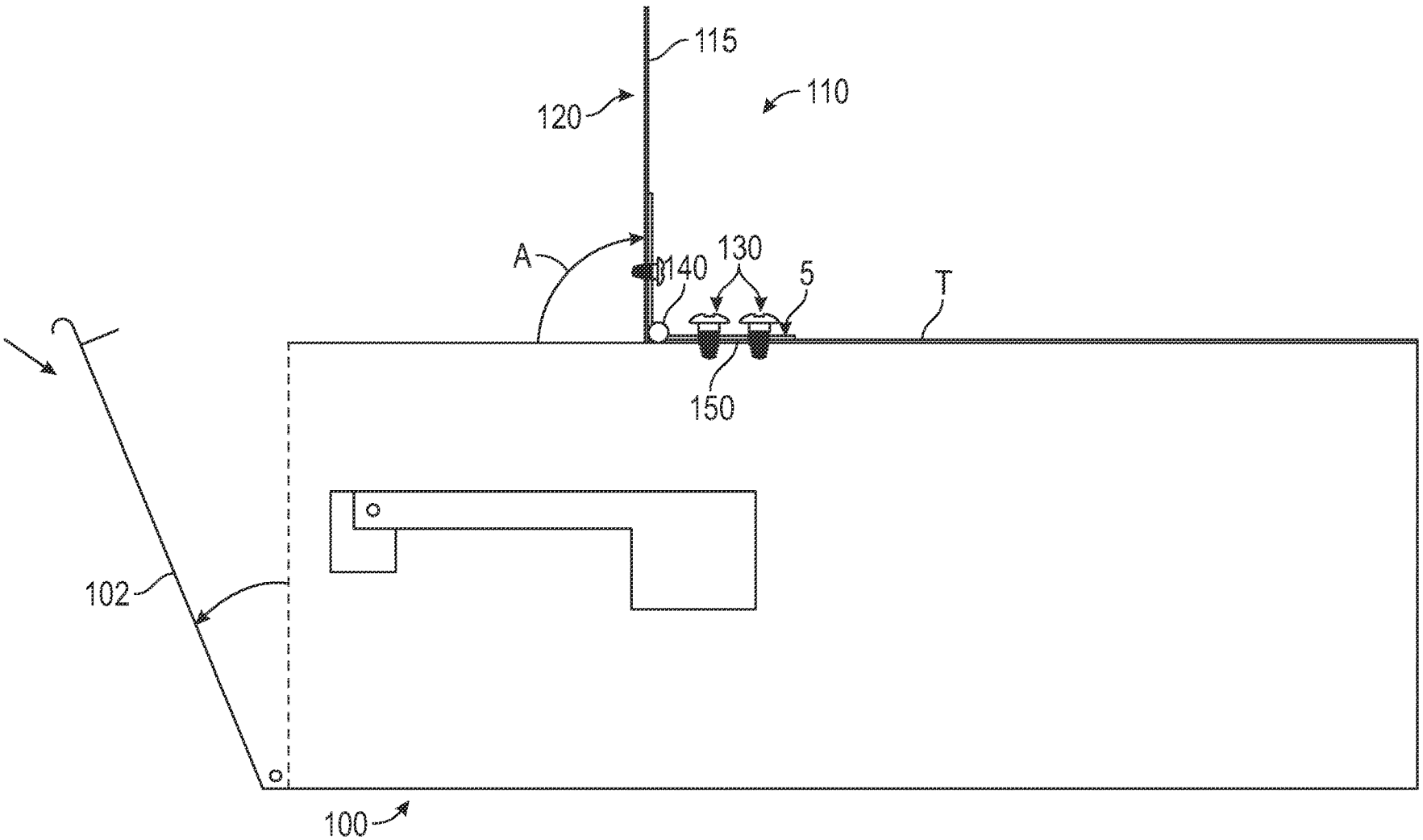
Figure 3C:
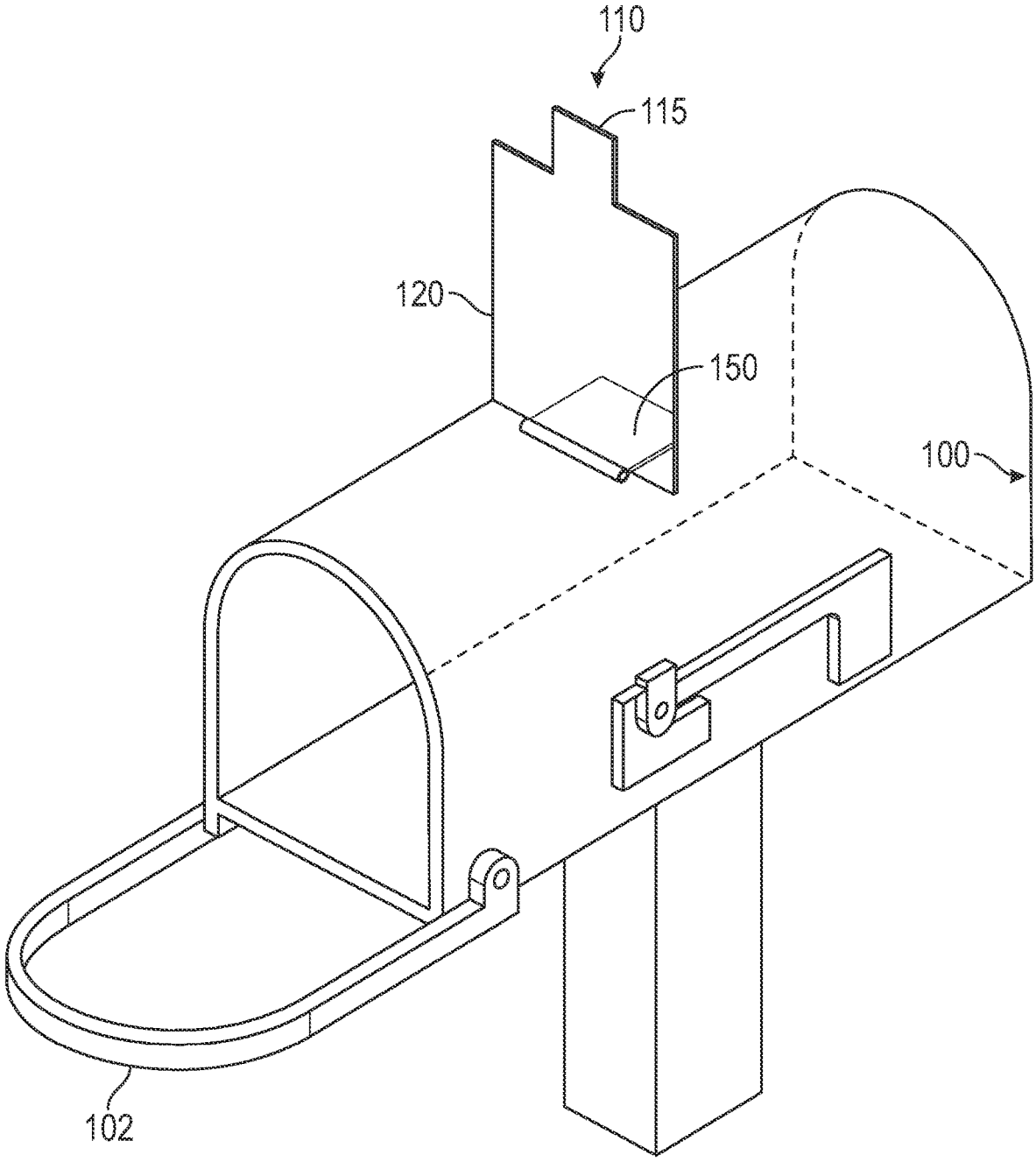

A first exemplary embodiment of an improved design is shown in FIGS. 3A, 3B, and 3C with mailbox 100 having a top T and a door 102. A notification flag assembly 110 is attached to the top T of the mailbox 100 with mounting plate 150 secured by securement means 130, which are shown in the figures as screws, but could be comprise different securement devices, including, for example, nuts/bolts, rivets, pins, etc. The notification flag assembly 110 includes a flap or flag 120 attached along a hinge 140. The flap 120 is shown in a closed position in FIG. 3A and in an open position in FIGS. 3B and 3C. The flap 120 includes an end 115 that can be secured under a lip of the lid 102 of the mailbox 100. The end 115 can be any desired orientation that is securable under the lip the of the lid 102, and is shown of narrower profile than the flag or flap 120 in FIG. 3C. The hinge 140 is a self-contained spring loaded hinge mounted directly to the mailbox. In at least one exemplary embodiment, the hinge and hinge spring can be made of stainless steel, which, for example, can add to the longevity of the apparatus. The self-contained, compact, spring loaded hinge in its compact form eliminates snagging of the elongated, spring on hinge, such as the one shown in FIG. 1A, e.g., due to snow load, branches, leaves and possible purposeful or accidental damage from users or passersby. Having a spring built into the hinge creates several advantages over prior design with the inventive hinge being designed to not break, degrade, or otherwise detach from the mailbox. The spring is designed to be strong to function in high winds, snow, and icy conditions, etc. When the hinge is mounted directly to the mailbox, snagging or breaking that could occur if the elongated hinge were exposed to the exterior of the mailbox is eliminated. Although the present description utilizes a stainless steel hinge and spring, the hinge and the hinge spring can be made of different materials, including, for example, various plastics, polymers, aluminum, etc.

Figure 4B:
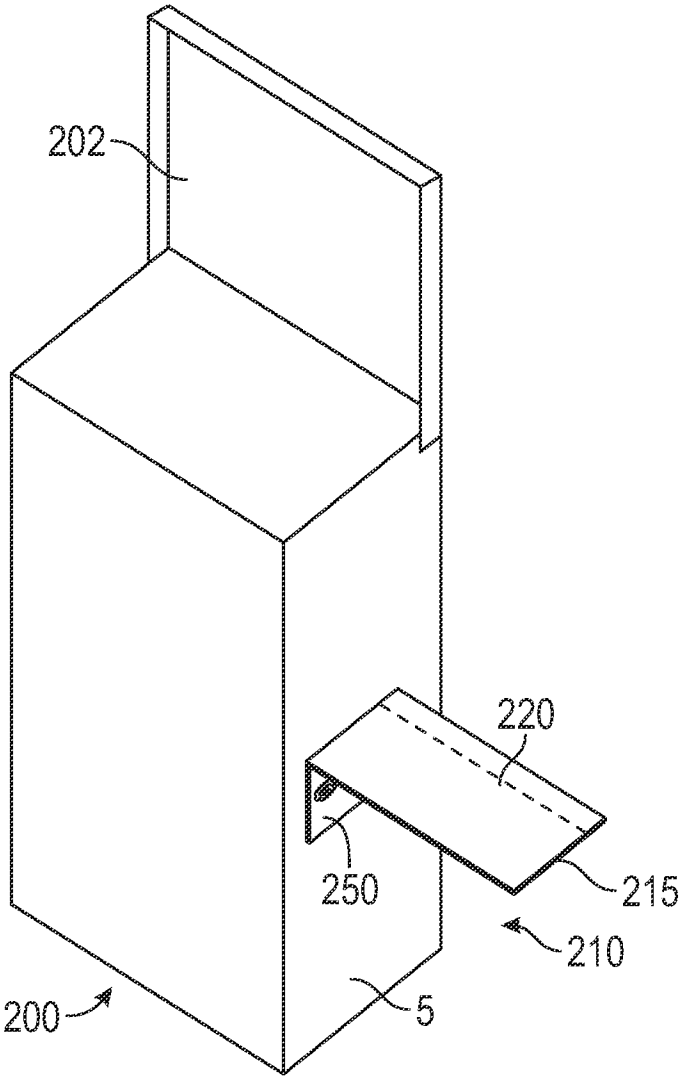
FIGS. 4A and 4B show a second embodiment of a mailbox notification apparatus for a top door or wall mount mailbox.
Figure 4A:
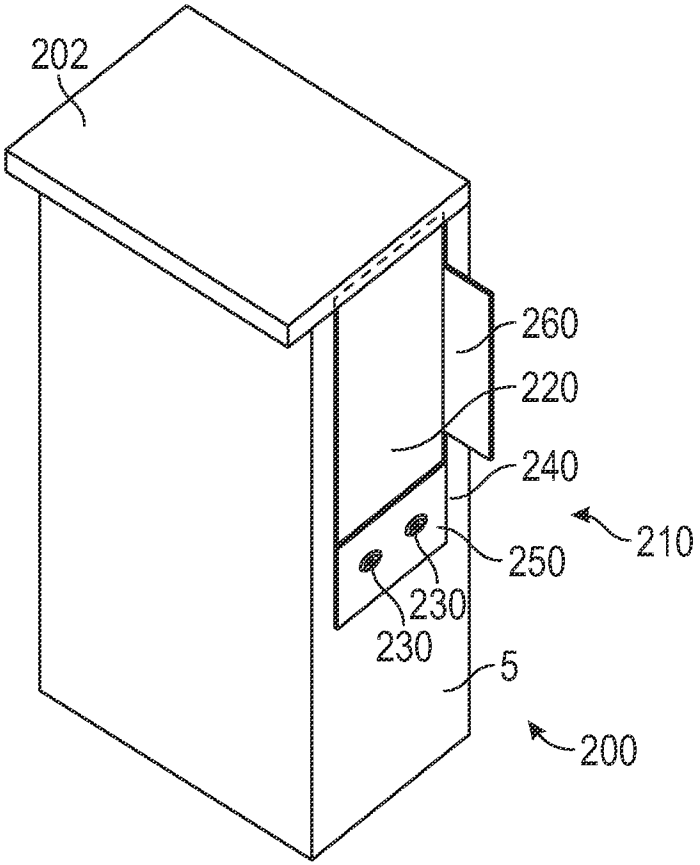

FIGS. 4A and 4B show a second exemplary embodiment of a mailbox notification apparatus for a top door or wall mount mailbox 200. Similar to the first embodiment, the second embodiment includes a mailbox notification assembly 210, but the assembly 210 in FIGS. 4A and 4B is attached to a side 5 of the mailbox 200 with the hinge plate 250 secured by securement means 230. The notification assembly 210 includes a flap or flag 220 attached along a spring loaded hinge 240. The flag 220 is shown in a closed position in FIG. 4A and in an open position in FIG. 4B. The flag 220 includes an end 215 that can be secured under a lip of the lid 202 of the mailbox 200. The end 215 can be any desired orientation that is securable under the lip the of the lid 102. The flag 220 can be mounted on either the right side or left side of a mailbox 200. The flag 220 also includes a flange 260 that is generally disposed at a 90-degree angle to the flag 220. This bent flange 260 provides an additional notification flag that can be seen from a side profile. A flange 260 for a right side mounted flag 220 is shown in FIGS. 4A and 4B, while a left side mounted flag 220 would have a flange 260 bent in the opposite direction. In one exemplary embodiment, the mounting plate 250 can be larger than the flag 220. For example, the mounting plate 250 can be three inches wide and 1.5 inches long, and the flag 220 can be 2.5 inches wide with a notifier flange 260 that is 0.5 inches wide.

Figure 5:
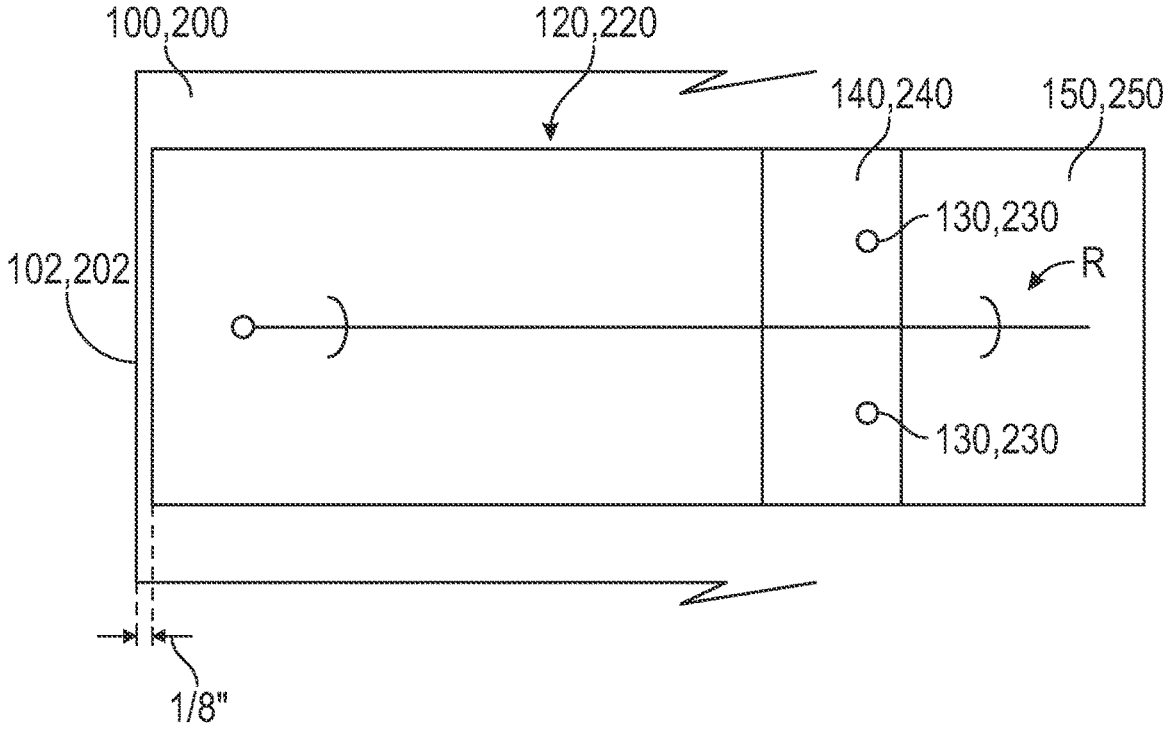
FIGS. 5 and 6 show exemplary installation positions of a notification flag.
Figure 6:
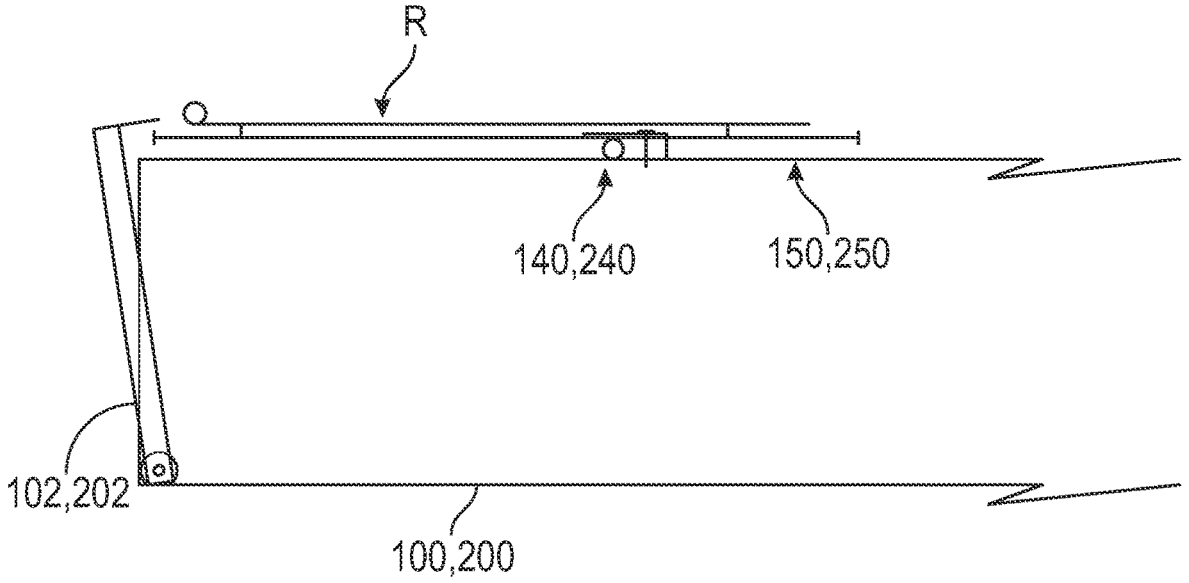

FIGS. 5 and 6 show exemplary installation positions of a notification flag. One exemplary installation method involves the following steps:

First, install the mailbox notification assembly ("Notifier") onto the mailbox 100, 200, generally either onto the top T or side 5. In at least one exemplary embodiment, a mailbox with a front door receives the Notifier on the top T of the mailbox. In contrast, in at least one exemplary embodiment, a mailbox with a top door receives the Notifier on the side 5 of the mailbox.

Second, the Notifier with the longer operable flap end is placed toward the mailbox door opening approximately ⅛" short of the very end of the opening edge of the mailbox. Note that the exemplary embodiment of FIG. 5 includes a temporary stretcher rod R which, if provided, should remain on the Notifier for installation running from end to end through the two holding loops located on the notifier flap end and the mounting bracket end. The Notifier can be oriented by aligning the Notifier to be parallel with the top and side of the mailbox. Additionally, if the Notifier is to be installed onto a mailbox with a top door, the rear edge of the notifier should be disposed approximately a quarter-inch away from the rear edge of the mailbox. The stretcher rod R is a temporary packaging and installation aid that can ease the installation process and can provide more accurate installation. The stretcher rod R keeps the notifier flap in a straight, elongated position during the installation process and allows for proper alignment of the apparatus with the side and opening of the receiver box during installation. The stretcher rod R is intended to be removed after the notification apparatus is installed.

Third, the Notifier is placed flat on the mailbox surface with the raised part of the hinge spring facing toward the surface of the box and the stretched rod on the outside of the Notifier. This will allow the spring-loaded hinge to operate correctly and move toward the 90 degree position when activated. In one exemplary aspect, the mounting plate side of the Notifier can include a shim, such as a plastic shim, fastened thereto. The mounting end of the hinge should be away from the mailbox opening.

Fourth, the mounting plate is attached to the mailbox, for example, by screwing two sheet metal screws through the mounting plate. The shim can be used as desired. The mounting plate should then be secured onto the mailbox.

Fifth, the mailbox door is closed over the edge of the Notifier flap. If provided, the temporary stretcher rod should be removed by holding the door closed and sliding the temporary stretcher rod out from the holding loops. The Notifier is now ready to be activated.

Sixth, the Notifier can be tested by opening the mailbox door. The Notifier flap will spring into action and should rotate to stop at an approximate 90-degree angle to the mailbox surface in the direction shown in FIG. 3B at A.

The embodiments detailed herein are exemplary only and are not intended to be limiting in any manner. For example, the notification flag can be manufactured and available as a separate unit to be installed or retrofit onto an existing mailbox as an after-market or do-it-yourself item. Additionally, the notification flag can be provided as an element of an original mailbox in its entirety.

In at least one exemplary embodiment, the apparatus can be comprised of three primary parts attached to a mailbox that has an overlapping access box door. The three primary parts of the apparatus are the notification flag, a spring loaded metal or plastic hinge, and attachment screws.

The spring loaded hinge and notification flag, in at least one exemplary embodiment, can be comprised of a single-piece of molded plastic or a spring loaded hinge attached to or comprised of a notification flag. The parts can be made of various materials, such as plastic or metal. In at least one exemplary embodiment, the apparatus can be made of a steel spring loaded hinge and an aluminum flag mechanically fastened to the hinge. The spring loaded hinge can be mechanically fastened to the top of the mailbox, e.g., with two or more screws, including sheet metal screws in at least one embodiment.

In at least one method of installation, when the notification flag apparatus is attached to a mailbox, the end of the notification flag activation tongue should be even with the end of the mailbox at the mailbox access door end of the mailbox. This positioning allows access door overlap to cover the tongue and hold down the notification flag when the mailbox door is in the closed position.

In at least one method of operation, when the access door is opened, the flag tongue will be released from the overlapping door lip allowing the spring to pull the flag upward into a vertical position for visual notification. When the mail delivery worker closes the mailbox door, e.g., after the mail has been deposited into the mailbox or after outgoing mail has been retrieved from the mailbox, the notification flag will be in a vertical or perpendicular position, indicating that the door has been opened and that mail has either been deposited or picked up.

When the recipient retrieves mail out of the mailbox, in order to reset the notification apparatus, the notification flag is pushed back, e.g. down to be disposed horizontally on top of the mailbox or otherwise hinged in a direction toward the door, and to close the access door lip in a position over the tongue of the flag. In this position, the access door lip will retain the flag down horizontally until the next time the mailbox is opened for mail to be deposited therein by a postal agent or for outgoing mail to be retrieved from the mailbox by a postal agent.

Similar features are indicated by similar numbers throughout the figures. The notification flap(s) or flag(s) detailed herewithin can be formed of various materials, including metals and/or plastic.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

The present disclosure can be understood more readily by reference to the instant detailed description, examples, and claims. It is to be understood that this disclosure is not limited to the specific systems, devices, and/or methods disclosed unless otherwise specified, as such can, of course, vary. It is also to be understood that the terminology used herein is for the purpose of describing particular aspects only and is not intended to be limiting.

The instant description is provided as an enabling teaching of the disclosure in its best, currently known aspect. Those skilled in the relevant art will recognize that changes can be made to the aspects described, while still obtaining the beneficial results. It will also be apparent that some of the desired benefits of the present disclosure can be obtained by selecting some of the features of the present disclosure without utilizing other features. Accordingly, those who work in the art will recognize that modifications and adaptations are possible and can even be desirable in certain circumstances and are a part of the present disclosure. Thus, the instant description is provided as illustrative of the principles of the present disclosure and not in limitation thereof.

As used herein, the singular forms "a," "an" and "the" include plural referents unless the context clearly dictates otherwise. Thus, for example, reference to a "body" includes aspects having two or more bodies unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Although several aspects of the disclosure have been disclosed in the foregoing specification, it is understood by those skilled in the art that modifications and other aspects will come to mind to which the disclosure pertains, having the benefit of the teaching presented in the foregoing description and associated drawings. It is thus understood that the disclosure is not limited to the specific aspects disclosed hereinabove, and that modifications and other aspects are intended to be included within the scope of the appended claims. Moreover, although specific terms are employed herein, as well as in the claims that follow, they are used only in a generic and descriptive sense, and not for the purposes of limiting the described disclosure.

What is claimed is:

1. A notification apparatus for a mailbox, the notification apparatus comprising:

a mounting plate;

a notification flap;

a self-contained spring loaded hinge between the mounting plate and the notification flap;

wherein the mounting plate is securable to a mailbox with at least a portion of the notification flap securable under a door of the mailbox; and wherein, when the door is opened, the flap rotates approximately 90-degrees about the hinge toward the mounting plate;

wherein a stretcher rod is removably attached to and extends above the flap and the mounting plate.

2. The apparatus of claim 1 wherein the flap includes a flange disposed at a 90-degree angle to the flap.

3. The apparatus of claim 2 wherein the flange rotates with the flap when the door is opened to provide a secondary notification that the door has been opened.

4. The apparatus of claim 1 wherein the mounting plate is secured to the mailbox by screws, rivets, or a nut and bolt combination.

5. The apparatus of claim 1 wherein the flap is disposed on a top of the mailbox.

6. The apparatus of claim 5 wherein the flap has a width and wherein an end portion of the flap has an end portion width that is less than the width of the flap.

7. The apparatus of claim 1 wherein the flap is disposed on a side of the mailbox.

8. The apparatus of claim 7 wherein the flap has a width and wherein an end portion of the flap has an end portion width that is less than the width of the flap.

9. A method of using a notification apparatus for a mailbox, the method comprising:

providing a mounting plate, a notification flap, and a self-contained spring loaded hinge between the mounting plate and the notification flap, with the mounting plate secured to the mailbox;

hinging at least a portion of the notification flap under a door of the mailbox; and wherein, when the door of the mailbox is opened, the flap rotating approximately 90-degrees about the hinge toward the mounting plate;

wherein a stretcher rod is removably attached to and extends above the flap and the mounting plate.

10. The method of claim 9 wherein the flap includes a flange disposed at a 90-degree angle to the flap.

11. The method of claim 10 wherein the flange rotates with the flap when the door is opened to provide a secondary notification that the door has been opened.

12. The method of claim 9 wherein the mounting plate is secured to the mailbox by screws, rivets, or a nut and bolt combination.

13. The method of claim 9 wherein the flap is disposed on a top of the mailbox.

14. The method of claim 13 wherein the flap has a width and wherein an end portion of the flap has an end portion width that is less than the width of the flap.

15. The method of claim 9 wherein the flap is disposed on a side of the mailbox.

16. The method of claim 15 wherein the flap has a width and wherein an end portion of the flap has an end portion width that is less than the width of the flap.

* * * * *